US005418117A

United States Patent [19]

Marsden

[11] Patent Number: 5,418,117

[45] Date of Patent: May 23, 1995

[54] METHOD OF PHOTOGRAPHIC PROCESSING

[75] Inventor: Peter D. Marsden, Middlesex, England

[73] Assignee: Eastman Kodak Company, Rochester, N.Y.

[21] Appl. No.: 276,064

[22] Filed: Jul. 15, 1994

[30] Foreign Application Priority Data

Jul. 24, 1993 [GB] United Kingdom ..... 9315366

[51] Int. Cl.[6] ..... G03C 7/407

[52] U.S. Cl. ..... 430/373; 430/357; 430/414; 430/486; 430/490; 430/943

[58] Field of Search ..... 430/357, 373, 414, 484, 430/485, 461, 486, 490, 943

[56] References Cited

U.S. PATENT DOCUMENTS

| | | | |
|---|---|---|---|
| 3,674,490 | 7/1972 | Matejec | 430/376 |
| 3,765,891 | 10/1973 | Travis | 430/351 |
| 4,045,225 | 8/1977 | Shimamura et al. | 430/943 |
| 4,045,226 | 8/1977 | Hara et al. | 430/943 |
| 4,414,305 | 11/1983 | Nakamura et al. | 430/373 |
| 4,469,780 | 9/1984 | Hirai et al. | 430/373 |
| 4,613,223 | 9/1986 | Cherry et al. | 354/322 |
| 5,215,875 | 6/1993 | Matejec et al. | 430/373 |
| 5,246,822 | 9/1993 | Evans et al. | 430/373 |
| 5,260,184 | 11/1993 | Marsden et al. | 430/414 |

FOREIGN PATENT DOCUMENTS

| | | |
|---|---|---|
| 1403418 | 8/1975 | United Kingdom . |
| 92/10790 | 6/1992 | WIPO . |

*Primary Examiner*—Hoa Van Le
*Attorney, Agent, or Firm*—Sarah Meeks Roberts

[57] ABSTRACT

A method of processing an imagewise exposed photographic silver halide colour material by a redox amplification method in wherein colour developing solution is applied to the material in the presence of atmospheric oxygen and a hydroxylamine compound of the formula:

(1)

wherein $R^1$ and $R^2$ are each an alkyl or aryl groups either of which may be substituted, and wherein the colour developer solution is agitated sufficiently for redox amplification to occur.

10 Claims, 3 Drawing Sheets

METHOD OF PHOTOGRAPHIC PROCESSING

FIELD OF THE INVENTION

The invention relates to photographic processing and, in particular, to a method of redox amplification processing.

BACKGROUND OF THE INVENTION

Redox amplification processes have been described, for example in British Specification Nos. 1,268,126, 1,399,481, 1,403,418, and 1,560,572. In such processes colour materials are developed to produce a silver image (which may contain only small amounts of silver) and then treated with a redox amplifying solution (or a combined developer-amplifier) to form a dye image.

The developer-amplifier solution contains a colour developing agent and an oxidising agent which will oxidise the colour developing agent in the presence of the silver image which acts as a catalyst.

Oxidised colour developer reacts with a colour coupler to form the image dye. The amount of dye formed depends on the time of treatment or the availability of colour coupler and is less dependent on the amount of silver in the image as is the case in conventional colour development processes.

Examples of suitable oxidising agents include peroxy compounds including hydrogen peroxide and compounds which provide hydrogen peroxide, eg addition compounds of hydrogen peroxide.

Any solution containing both a colour developing agent and hydrogen peroxide is inherently unstable as the peroxide tends to react with the colour developing agent and destroy it. Many proposals have been made on how this instability can be overcome but without providing the solution stability of conventional colour processing.

One of such proposals is to add oxidant to a colour developer solution only when it is needed and to remove it after use, recycling the colour developer solution which is left. Such methods need elaborate control mechanisms, especially at start-up, in order to ensure a practical system.

It is well-known to use rotating drums in photographic processing apparatus. Such machines may comprise a rotatable drum having a textured stainless steel surface mounted horizontally whose lower surface dips into processing solution held in a tray-like container. In a hand-operated drum processor each processing solution is poured into the container and then tipped out of it and discarded when the particular processing step has been carried out for the necessary length of time.

U.S. Pat. No. 4,613,223 discloses a more mechanised embodiment in which a flexible sheet of photographic material is driven along an endless curved path within a processing tank by passing the sheet through nips formed between at least one pair of driven rollers. At least one of the driven rollers is the drum itself. During processing, the emulsion (sensitive) surface of the sheet is arranged not to come into contact with any stationary part of the processing vessel as it is being processed. This prevents damage to the surface during processing. After driving the sheet around the endless path for a predetermined number of cycles, which defines the processing time, the sheet is then directed out of the processing tank.

PCT published specification WO 92/10790 describes a high speed processor in which an applicator belt disposed in the vertical plane carries out essentially the same function as the drum of a drum processor.

Problem to be Solved by the Invention

The use of hydrogen peroxide or any compound which provides it gives instability problems as described above as well as needing a separate storage container and delivery means to deliver it to the appropriate part of a processing machine.

SUMMARY OF THE INVENTION

According to the present invention there is provided a method of processing an imagewise exposed photographic silver halide colour material by a redox amplification method in wherein colour developing solution is applied to the material in the presence of atmospheric oxygen and a hydroxylamine compound of the formula:

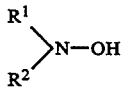

(1)

wherein $R^1$ and $R^2$ are each H or an alkyl or aryl groups either of which may be substituted, and wherein the colour developer solution is agitated sufficiently for redox amplification to occur.

Advantageous Effect of the Invention

The present invention provides a simpler redox amplification system than has previously been described, eliminates the use of hydrogen peroxide thus saving cost and the provision of means associated with its delivery and control in a processing machine together with any stability problems associated with the simultaneous presence in a processing solution of a colour developing agent and an oxidant.

DETAILED DESCRIPTION OF THE INVENTION

The agitation of the colour developer solution is preferably achieved using a drum processor in which agitation in the presence of air occurs naturally or by increasing the surface area of the solution in an oxygen-containing atmosphere, for example, spraying or atomising the solution in an enclosing space containing air and recondensing before use or by bubbling air through the solution. Devices which aerate small volumes of solution at a time are preferred.

Figure 3:
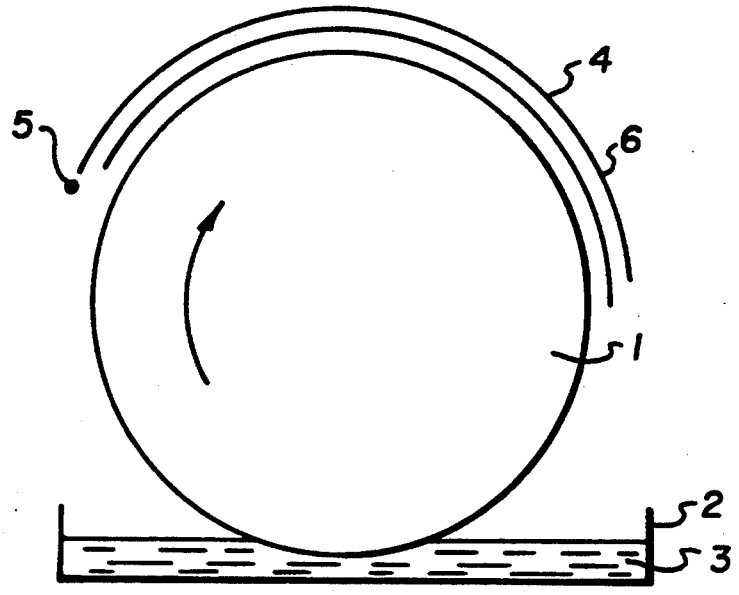
FIG. 3 shows a cross-section of a drum processor.

In one embodiment of the present invention a drum processor illustrated in FIG. 3 may be used. FIG. 3 shows a cross-section of the drum processor which comprises a rotatable stainless steel drum having a textured surface which, in use, dips into the processing solution (3) held in tray (2). A mesh sheet (4) is attached to a bar (5) which is held in place by a fixing means attached to a stationary part of the apparatus (not shown). In use the sheet of photographic material to be processed (6) is held by the mesh sheet (4) with its emulsion side facing the drum (1) rotating in the direction shown whereby a film of processing solution separates the material from the rotating drum. The processing solution is thereby agitated vigorously.

The material (6) may be placed on the drum either by hand or by a suitable mechanism.

Alternatively the processors described in U.S. Pat. No. 4,613,223 or PCT published specification WO 92/10790 (both as described above) may be used.

$R^1$ and $R^2$ of formula (1) may be an alkyl group of 1-5 carbon atoms which itself may be substituted by one or more halogen atoms or alkyl or aryl groups or an aryl group which itself may be substituted by one or more halogen atoms or alkyl or aryl groups. Examples of such compounds are dimethylhydroxylamine, diethylhydroxylamine, methylethylhydroxylamine, diphenylhydroxylamine and phenylethylhydroxylamine.

The preferred colour developing agents for use in the colour developer solution employed herein are p-phenylenediamines. Especially preferred are:

4-amino-3-methyl-N,N-diethylaniline hydrochloride,
4-amino-3-methyl-N-ethyl-N-β-(methanesulphonamido)-ethylaniline sulphate hydrate,
4-amino-3-methyl-N-ethyl-N-β-hydroxyethylaniline sulphate,
4-amino-3-β-(methanesulphonamido)ethyl-N,N-diethylaniline hydrochloride and
4-amino-N-ethyl-N-(2-methoxy-ethyl)-m-toluidine di-p-toluene sulphonate.

The pH of the developer solution is preferably from 11 to 12.5, more preferably from 11.1 to 12.3 with 11.7 being a particularly preferred value.

The redox amplification step may be preceded by a development step which produces a silver image which can then act as a catalyst for the colour image amplification. This is the so-called DEV/DEVAMP process.

A particular application of this technology is in the processing of silver chloride colour paper, for example paper comprising at least 85 mole percent silver chloride, especially such paper with low silver levels, for example for a single layer coating levels below 30 mg/m², preferably below 20 mg/m². The total silver coating level for a multicolour material is, for example, below 150 mg/m², preferably from 10 to 120 mg/m².

The photographic elements can be single colour elements or multicolour elements. Multicolour elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolour photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a coupler of this invention. The element can contain additional layers, such as filter layers, interlayers, overcoat layers, subbing layers, and the like. Such colour materials are described in Research Disclosure Item 308119, December 1989 published by Kenneth Mason Publications, Emsworth, Hants, United Kingdom.

The following Examples are included for a better understanding of the invention, but the invention is not limited thereto.

EXAMPLE 1

A colour photographic paper with essentially pure silver chloride emulsions with silver chloride grains having the following edge lengths:—yellow 0.38 micron; magenta 0.31 micron; cyan 0.38 micron. The silver laydowns were:—yellow 54 mg/m²; magenta 38 mg/m²; cyan 32 mg/m² (making a total silver L/D of 124 mg/m².

Two 10 ins lengths of the paper were exposed to a four colour wedge (giving red, green, blue and neutral exposures) for 0.1 sec on a DF1 sensitometer.

Two liters of the following developer solution was prepared:

| Colour Developer 1 | |
|---|---|
| 1-Hydroxyethylidene-1,1'-Diphosphonic acid | 0.9 g |
| Diethyltriamine-pentaacetic acid | 3.0 ml |
| $K_2HPO_4 3H_2O$ | 30 g |
| KBr | 1.0 mg |
| KCl | 0.5 g |
| Diethylhydroxylamine (85%) | 3.0 ml |
| Catechol disulphonate (Na salt) | 0.45 g |
| KOH | 8.0 g |
| 4-N-Ethyl-N-(β-methanesulphonamidoethyl)-o-toluidine sesquisulphate (CD3) | 4.8 g |
| Water to | 1000 ml |
| pH (27° C.), adj with KOH to | 11.70 |

1) One strip was processed with the following process cycle:—

| | |
|---|---|
| Develop in 2 liter tank 32° C. (using the above solution, hand agitation) | 45 sec |
| Stop 2% acetic acid | 30 sec |
| Wash | 30 sec |
| Bleach/Fix (EKTACOLOR RA4) | 30 sec |
| Wash | 60 sec |

Figure 1:
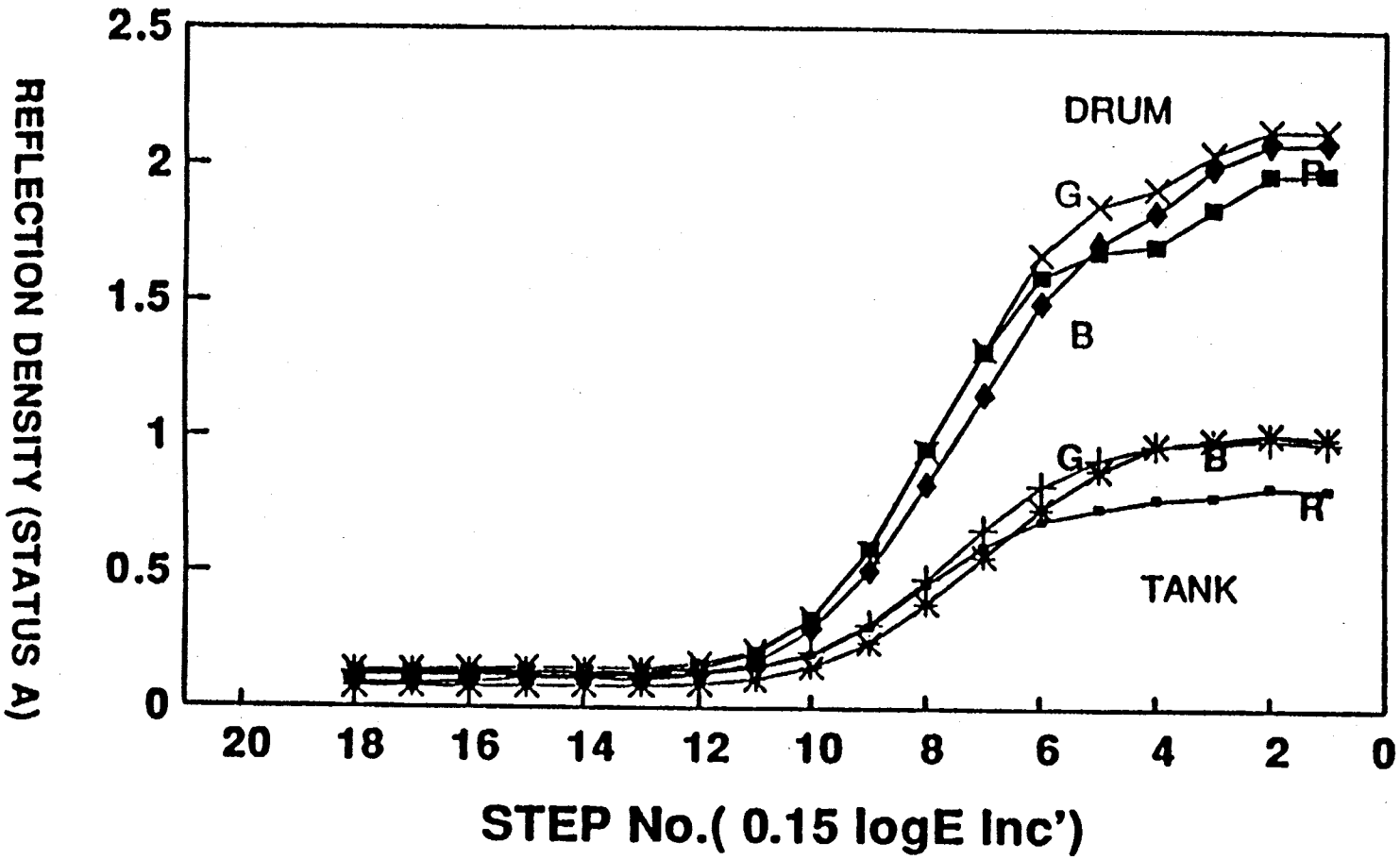
FIGS. 1 and 2 of the accompanying drawings are characteristic curves illustrating the results of the Examples.

Little or no redox amplification was observed as expected (FIG. 1).

2) The other strip was processed in an identical way but the development stage was carried out on an H11 drum processor using 100 ml of the developer in the drum tray. The drum was 8.4 ins diameter (12 ins long) with a stainless steel patterned surface and rotated at 82 revs/min. The same development/amplification time was given (45 sec). High redox amplification was observed due to aerial oxidation on the drum surface during processing producing hydrogen peroxide species. the sensitometric curves showing the red, green and blue densities vs. logE curves of the two processes are shown in FIG. 1.

The reason for the amplification being "switched on" is due to aeration of the developer as the drum rotates.

EXAMPLE 2

The developer formula shown above (Colour Developer 1) was remade without the diethylhydroxylamine and the pH was adjusted to the same value (11.7). A strip of exposed paper was processed on the drum processor for 75 seconds at 35° C. followed by stop, bleach-/fix and wash as shown in Example 1. A high minimum density with no amplification was observed for the developer containing no diethylhydroxylamine. Dmax/Dmin values are shown in Table 1.

TABLE 1

| | Dmax (neutral) | | | Dmin | | |
|---|---|---|---|---|---|---|
| | R | G | B | R | G | B |
| Developer with Diethylhydroxylamine | 2.65 | 2.60 | 2.62 | 0.127 | 0.148 | 0.106 |
| Developer without Diethylhydroxylamine | 0.990 | 1.43 | 1.21 | 0.212 | 0.297 | 0.226 |

EXAMPLE 3

Figure 2:
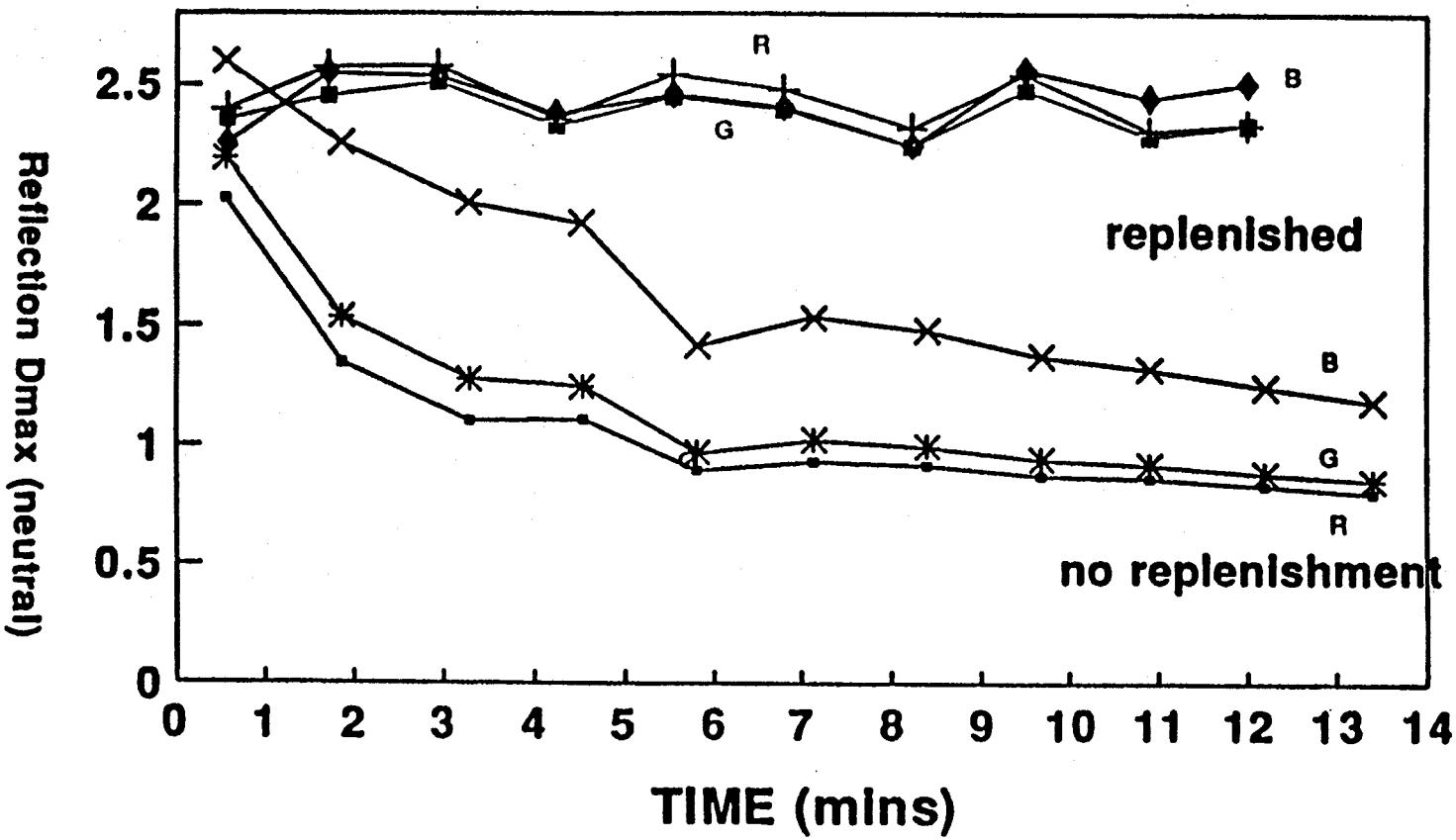

A mechanised drum processor (10 cm diameter hollow drum with a spiral patterned surface, 30 cm long, and rotating at 240 revs/min in a tray) for sheet material was adapted to run continuously with a 12.5 cm web at a speed of 19 cm/min and a development time of 70 sec. The rest of the process steps (stop, wash, bleach/fix, wash) were carried out by hand as the web emerged from the machine.

a) The Drum tray was filled with 100 ml developer (above). An 2.5 m length of the coating carrying 11 wedge exposures was processed through the machine. The R,G,B Dmax values (neutral) are plotted against time and are shown in FIG. 2. The initial wedge showed good redox amplification but this decreased as more paper was run through the machine. This loss could arise from a number of causes e.g. build up of chloride ion, a drop in pH, loss of processing solution, insufficient supply of oxygen.

b) The following replenisher was made:—

| | |
|---|---|
| 1-Hydroxyethylidene-1,1'-diphosphonic acid | 0.9 g |
| Diethyltriamine-pentaacetic acid | 3.0 ml |
| $K_2HPO_43H_2O$ | 33 g |
| KBr | 0.0 mg |
| KCl | 0.0 g |
| Diethylhydroxylamine (85%) | 3.9 ml |
| Catechol disulphonate (Na salt) | 0.45 g |
| KOH | 12.0 g |
| CD3 | 6.8 g |
| Water to | 1000 ml |
| pH (27° C.), adj with KOH | 12.10 |

Two pumps were arranged so that this replenisher could be fed into the drum tray (containing 100 ml working developer) at 3.5 ml/min and working developer removed (i.e. "overflow") at 3.37 ml/min. Replenishment rate was approximately 139 ml/m$^2$.

A further 2.5 m length of paper was processed with this arrangement and the Dmax values plotted in FIG. 2. This time the redox amplification held up well indicating that oxygen absorption was not limiting with this processor configuration.

The invention has been described in detail with particular reference to preferred embodiments thereof, but it will be understood the variations and modifications can be effected within the spirit and scope of the invention.

What is claimed is:

1. A method of processing an imagewise exposed photographic silver halide colour material by a redox amplification method wherein colour developing solution is applied to the material in the presence of atmospheric oxygen and a hydroxylamine compound of the formula:

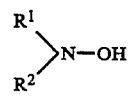

(1)

wherein $R^1$ and $R^2$ are each an alkyl or aryl groups either of which may be substituted, and wherein the colour developer solution is agitated sufficiently for redox amplification to occur.

2. The method as claimed in claim 1 in which the processing is carried out in a drum processor.

3. The method as claimed in claim 2 in which the drum processor is either fed by hand or mechanically.

4. The method as claimed in claim 1 in which the colour developer solution has a pH in the range 11–12.5.

5. The method as claimed in claim 4 in which the colour developer solution has a pH in the range 11.1–12.3.

6. The method as claimed in claim 1 in which the compound of formula (1) is dimethylhydroxylamine, diethylhydroxylamine, methylethylhydroxylamine, diphenylhydroxylamine or phenylethylhydroxylamine.

7. The method as claimed in claim 1 in which the redox amplification step is preceded by a development step which produces a silver image.

8. The method as claimed in claim 1 in which the photographic material is a paper comprising at least 85 mole percent silver chloride.

9. The method as claimed in claim 1 in which the photographic material is a colour paper with a total silver coating weight below 150 mg/m$^2$.

10. The method as claimed in claim 9 in which the photographic material is a colour paper with a total silver coating weight from 10 to 120 mg/m$^2$.

* * * * *